US008052583B1

(12) United States Patent
Tsai

(10) Patent No.: US 8,052,583 B1
(45) Date of Patent: Nov. 8, 2011

(54) SWIVEL EXERCISER

(75) Inventor: Jao-Hsing Tsai, Hsinchu (TW)

(73) Assignee: Cheng-Kang Chu, Hsinchu (TW)

( * ) Notice: Subject to any disclaimer, the term of this patent is extended or adjusted under 35 U.S.C. 154(b) by 0 days.

(21) Appl. No.: 12/944,861

(22) Filed: Nov. 12, 2010

(30) Foreign Application Priority Data

Jul. 20, 2010 (TW) ..... 99213810 U

(51) Int. Cl.
*A63B 21/068* (2006.01)
*A63B 21/00* (2006.01)

(52) U.S. Cl. ..... 482/96; 482/132; D21/662

(58) Field of Classification Search ..... 482/51–53, 482/79–80, 140–142, 148, 95–96, 132; D21/662, D21/689
See application file for complete search history.

(56) References Cited

U.S. PATENT DOCUMENTS 4,669,723 A * 6/1987 Arsenian ..... 482/71
4,799,475 A * 1/1989 Iams et al. ..... 601/23
4,846,465 A * 7/1989 Iams et al. ..... 482/132
4,858,918 A * 8/1989 Iams et al. ..... 482/132
4,886,050 A * 12/1989 Iams et al. ..... 601/23
4,989,860 A * 2/1991 Iams et al. ..... 482/132
5,141,483 A * 8/1992 Smith ..... 482/142
5,306,223 A * 4/1994 Martinez ..... 482/142
5,607,374 A * 3/1997 Hesse ..... 482/51
6,440,045 B1 * 8/2002 Gaston ..... 482/140
6,485,398 B1 * 11/2002 Kreft ..... 482/94
6,626,807 B1 * 9/2003 Richmond ..... 482/123
7,156,786 B1 * 1/2007 Palmer ..... 482/132
D567,312 S * 4/2008 Tsai ..... D21/688
7,666,121 B2 * 2/2010 Zhou ..... 482/51
D613,351 S * 4/2010 Splane ..... D21/689
D626,608 S * 11/2010 Tsai ..... D21/689
D631,108 S * 1/2011 Brodess et al. ..... D21/689
D631,519 S * 1/2011 Chen ..... D21/689
2005/0043143 A1 * 2/2005 Chuang ..... 482/51
2005/0266964 A1 * 12/2005 Teng ..... 482/71
2007/0149370 A1 * 6/2007 Brown et al. ..... 482/140
2009/0203499 A1 * 8/2009 Svatkova Hoeven et al. .... 482/1
2010/0062914 A1 * 3/2010 Splane ..... 482/96

* cited by examiner

*Primary Examiner* — Stephen Crow

(57) ABSTRACT

A swivel exerciser includes a base having two front legs, a rear leg, a head tube in a center of a front portion, and two spaced hand grips on a top end of the head tube. A sector-shaped plate on a top of the base includes two central pivot members. A curved rail is around a curved edge of the sector-shaped plate, with the rail being fixedly secured to the top of the base. Two pivotal arms are rearward splayed out of the pivot members respectively. Two knee plates are disposed on the other ends of the arms, and each includes a wheel disposed on the rail and adapted to move therealong. A projection is disposed at a joining portion of each arm and knee plate and includes a through hole. An inverted U-shaped bridge member is adapted to insert into the through holes to interconnect the projections or not.

5 Claims, 6 Drawing Sheets

SWIVEL EXERCISER

BACKGROUND OF THE INVENTION

1. Field of Invention

The invention relates to exercise equipment and more particularly to a swivel exerciser with improved characteristics.

2. Description of Related Art

The fitness craze captivating the attention of increasing numbers of people throughout the world has spawned an endless array of exercise equipment. One particular area of concentration for manufacturers and promoters of exercise equipment has been twisting or swivel exercisers.

A typical twisting exerciser is shown in FIG. 5. The exerciser comprises a base 1, a first pivot assembly 2 provided on a front portion of the base 1, a pair of handlebars 4 extending in an upwardly inclined direction from a front end of the first pivot assembly 2, a second pivot assembly 3 provided on a rear portion of the base 1, and a pair of knee plates 5 fixedly secured to the second pivot assembly 3. For exercising, a user may rest his or her knees on the knee plates 5 while the user's hands are grasping the handlebars 4 prior to repeatedly turning horizontally on a pivot in a joining portion of the first and second pivot assemblies 2, 3.

However, the conventional twisting exerciser of FIG. 5 suffers from a number of disadvantages. For example, each knee plate 5 is supported by an arm. This means a substantial portion of the body weight is supported by the arms. Thus, the arms tend to break after a short period time of use. This is unsafe. Further, the arms may vibrate irregularly due to the swivel motion of the body. The user may feel a degree of discomfort when using the exerciser. Moreover, the only function of the swivel motion is monotonous. People may easily become less attractive to the twisting exerciser.

Another typical swivel exerciser is shown in FIG. 6. The exerciser comprises a base 10 having two front legs 11 and two rear legs 12, a socket assembly 13 provided on a front portion of the base 10, two spaced hand grips 131, 132 telescopically secured to both sides of the socket assembly 13 respectively, a sector-shaped plate 14 on top of the base 10, a curved rail 15 provided on top of the edge of the sector-shaped plate 14, two arms 16 rearward splayed out of a central portion of the sector-shaped plate 14, two knee plates 17 each provided on the other end of the arm 16, a bridge member 18 interconnecting the knee plates 17, and two wheels each mounted on underside of the knee plate 17. The wheels are adapted to move along the curved rail 15 as a user swings for exercise.

The conventional swivel exerciser of FIG. 6 has improved stability due to the provision of four legs 11, 12 arranged as four corners of a trapezoid. However, it still suffers from a disadvantage of being unstable in use (i.e., vibrating irregularly), because there is no support under the spaced hand grips 131, 132 (i.e., the forward portion being suspended). Thus, the need for improvement still exists.

SUMMARY OF THE INVENTION

It is therefore one object of the invention to provide a swivel exerciser comprising a base comprising two spaced front legs, a rear leg, a head tube disposed in a center of a front portion, and two spaced hand grips disposed on a top end of the head tube. The base is elevated. A sector-shaped plate is disposed on a top of the base and includes two central pivot members. A curved rail is disposed around a curved edge of the sector-shaped plate, with the curved rail being fixedly secured to the top of the base. Two pivotal arms are rearward splayed out of the pivot members respectively. A knee plate is disposed on the other end of the arm distal the pivot member and includes a wheel disposed on the curved rail and adapted to move therealong. A projection is disposed at a joining portion of the arm and the knee plate and includes a through hole. In a first operation mode, both ends of an inverted U-shaped bridge member are inserted into the through holes to interconnect the projections so that the knee plates can rotate as a whole. In a second operation mode, the projections are not connected by the inverted U-shaped bridge member so that one knee plate can rotate independently of the other knee plate.

The above and other objects, features and advantages of the invention will become apparent from the following detailed description taken with the accompanying drawings.

DETAILED DESCRIPTION OF THE INVENTION

Figure 1:
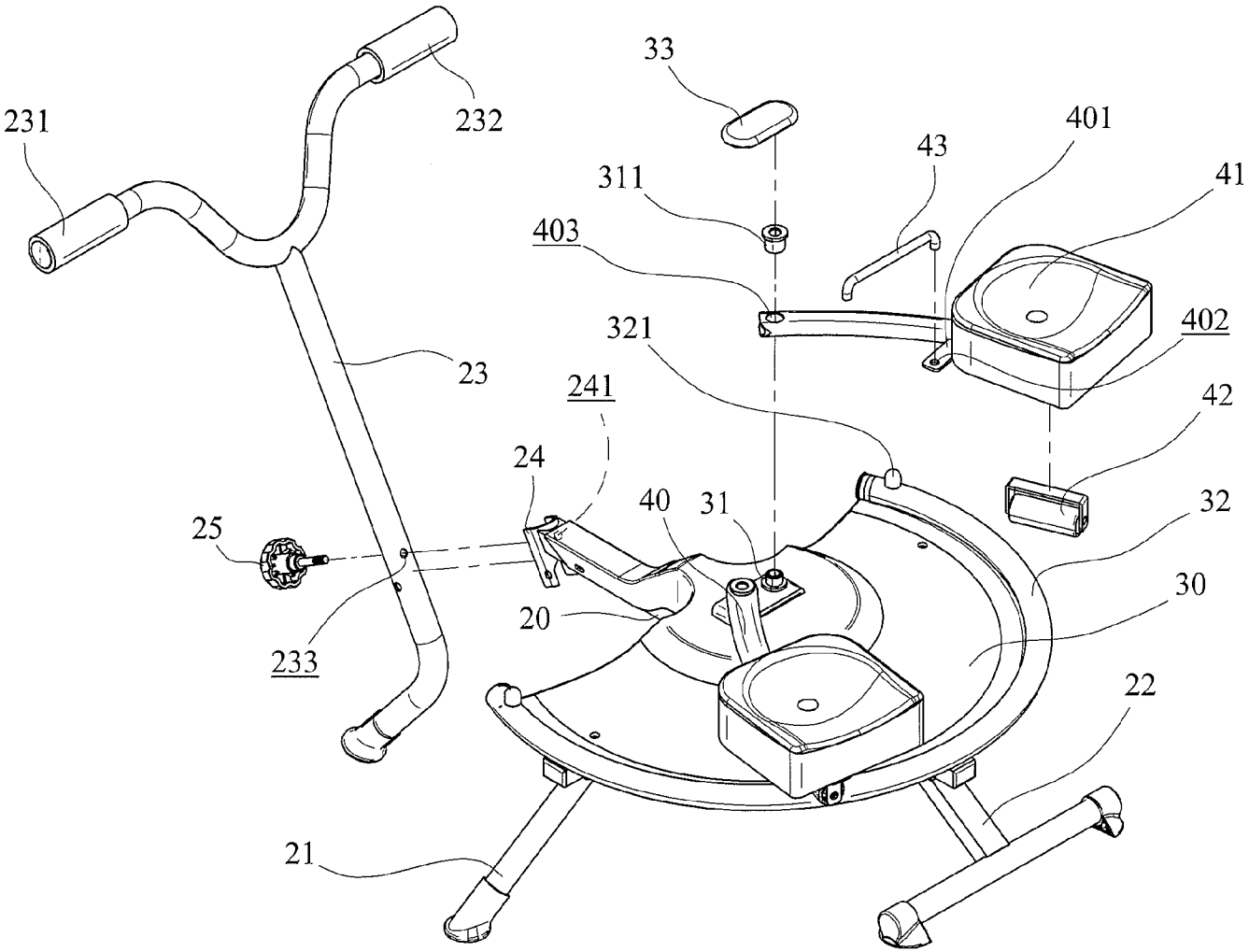
FIG. 1 is an exploded view of a swivel exerciser according to the invention.
Figure 2:
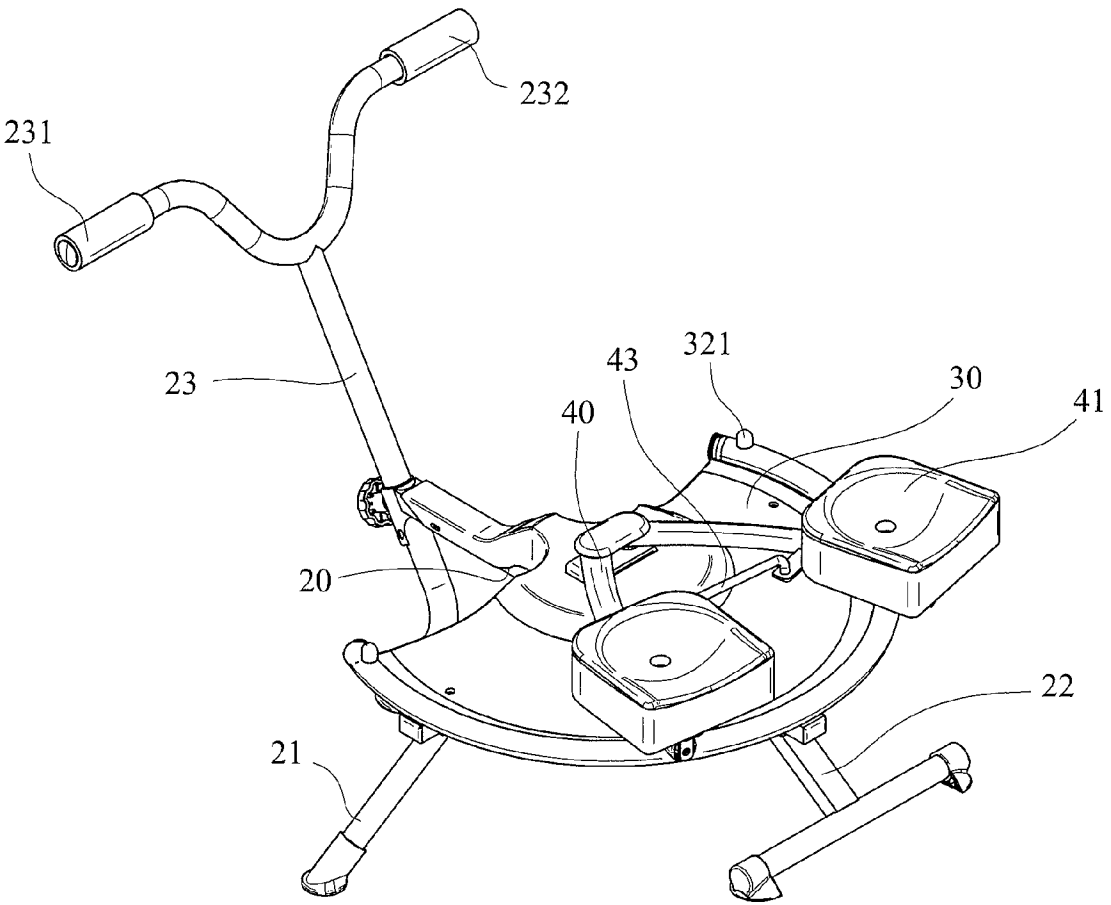
FIG. 2 is a perspective view of the assembled swivel exerciser.

Referring to FIGS. 1 to 4, a swivel exerciser in accordance with the invention comprises the following components as discussed in detail below.

A base 20 comprises two spaced front legs 21, an inverted T-shaped rear leg 22, a bent head tube 23 provided in a center of a front portion, and two spaced hand grips 231, 232 provided on a top end of the bent head tube 23. The base 20 is elevated due to the provision of the legs 21, 22.

A sector-shaped plate 30 is provided on top of the base 20 and comprises two pivot members 31 on a central portion. A curved rail 32 is provided around a curved edge of the sector-shaped plate 30. The curved rail 32 is fixedly secured to the top of the base 20.

Two pivotal arms 40 are rearward splayed out of the pivot members 31 respectively (i.e., being pivotably secured thereto). Two knee plates 41 are provided on the other ends of the pivotal arms 40. Two wheels 42 are mounted on the undersides of the knee plates 41. The wheels 42 are adapted to move along the curved rail 32. Two projections 401 are provided at joining portions of the pivotal arms 40 and the knee plates 41. The projections 401 face each other. A through hole 402 is provided on an open end of each projection 401. An inverted U-shaped bridge member 43 has both ends inserted into the through holes 402 to interconnect the projections 401 (i.e., the knee plates 41) so that the knee plates 41 can rotate as a whole as detailed later.

A projecting stop member 321 is provided on top of either end of the curved rail 32. The provision of the projecting stop members 321 can prevent the wheels 42 from moving out of the curved rail 32, i.e., the wheels 42 being limited to move along the curved rail 32 either clockwise or counterclockwise. A longitudinal member 24 of C-section is provided on a front end of the base 20. A threaded hole 241 is provided on a surface of the longitudinal member 24. A through hole 233 is provided on a lower portion of the bent head tube 23. A locating screw 25 is driven through the through hole 233 into the threaded hole 241 to secure the bent head tube 23 to the base 20.

A through hole 403 is provided on one end of either pivotal arm 40. The through holes 403 are pivotably put on the pivot members 31 respectively. Two fasteners 311 are driven through the through holes 403 into the pivot members 31 to pivotably fasten the pivotal arms 40 and the sector-shaped plate 30 together. Moreover, a protective cap 33 may be provided on the pivot members 31.

Figure 3:
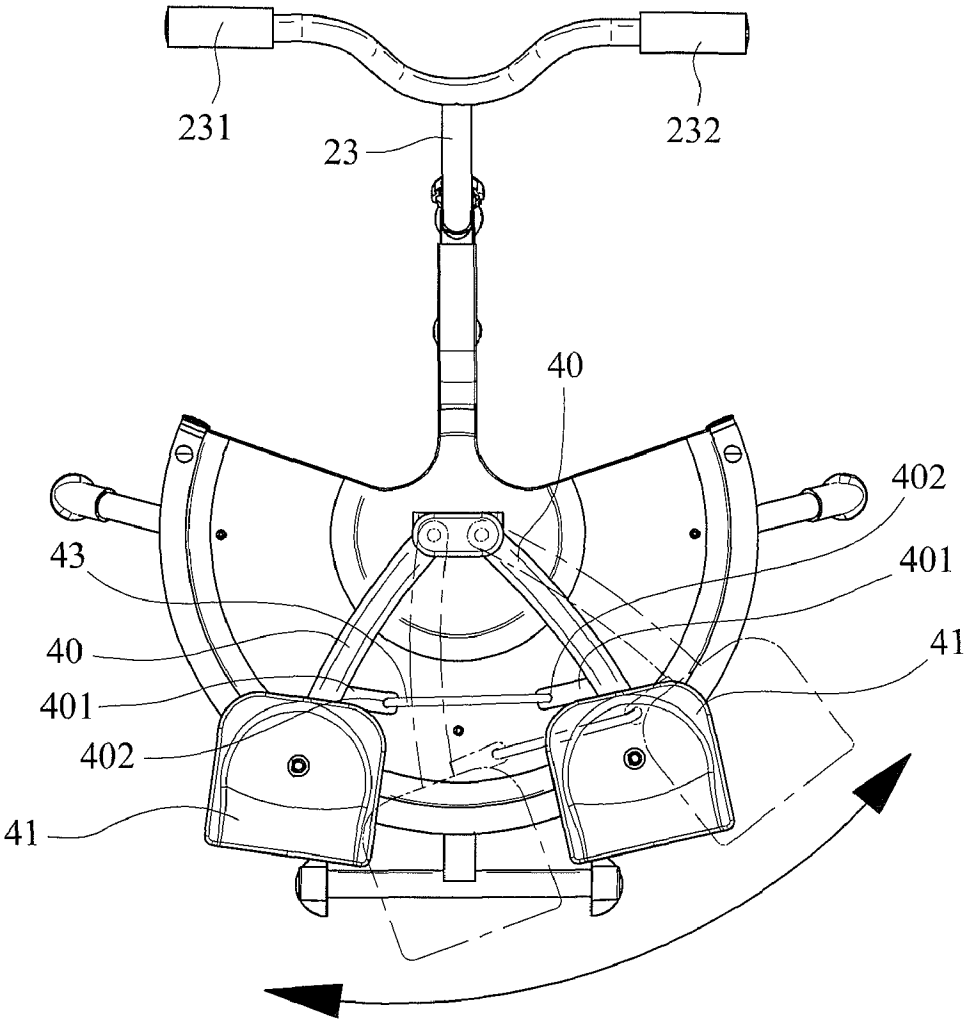
FIG. 3 is a top plan view showing one swivel motion of the exerciser.

As shown in FIG. 3 specifically, in one exercise mode, the inverted U-shaped bridge member 43 has both ends inserted into the through holes 402 to interconnect the projections 401 (i.e., the knee plates 41) so that the knee plates 41 and the pivotal arms 40 can rotate as a whole either clockwise or counter clockwise as indicated by a two-head arrow.

Figure 4:
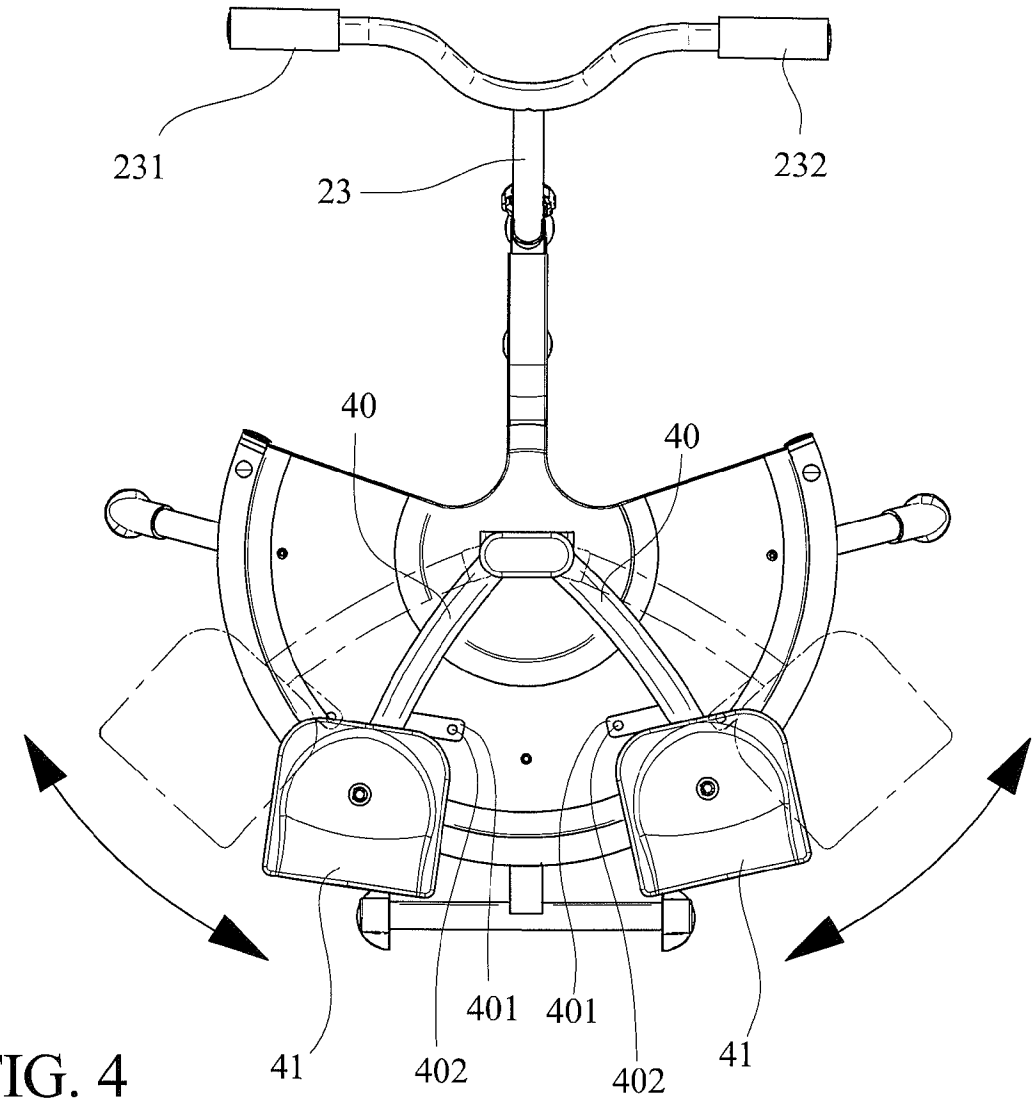
FIG. 4 is a top plan view showing the other swivel motion of the exerciser.
Figure 5:
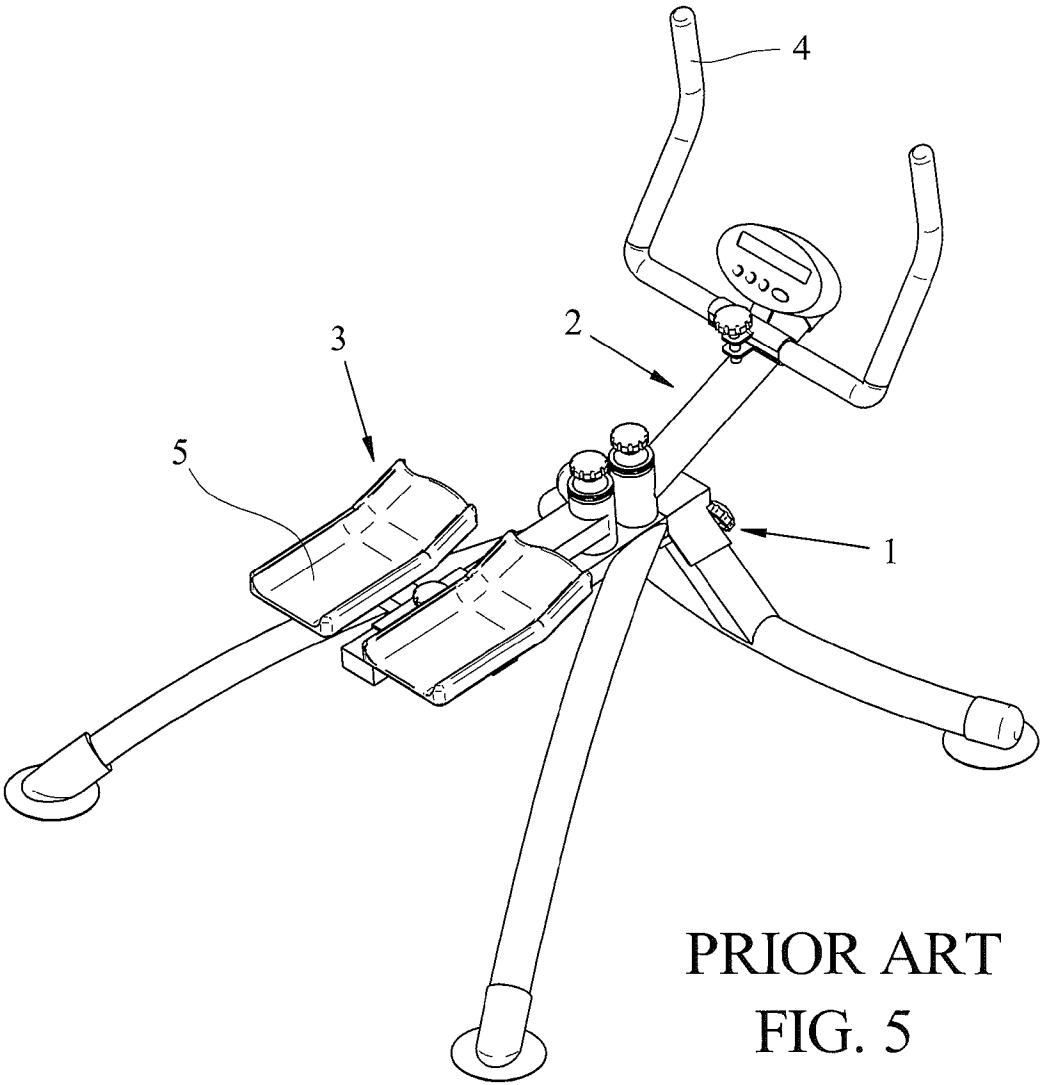
PRIOR ART FIG. 5
FIG. 5 is a perspective view of a typical twisting exerciser.
Figure 6:
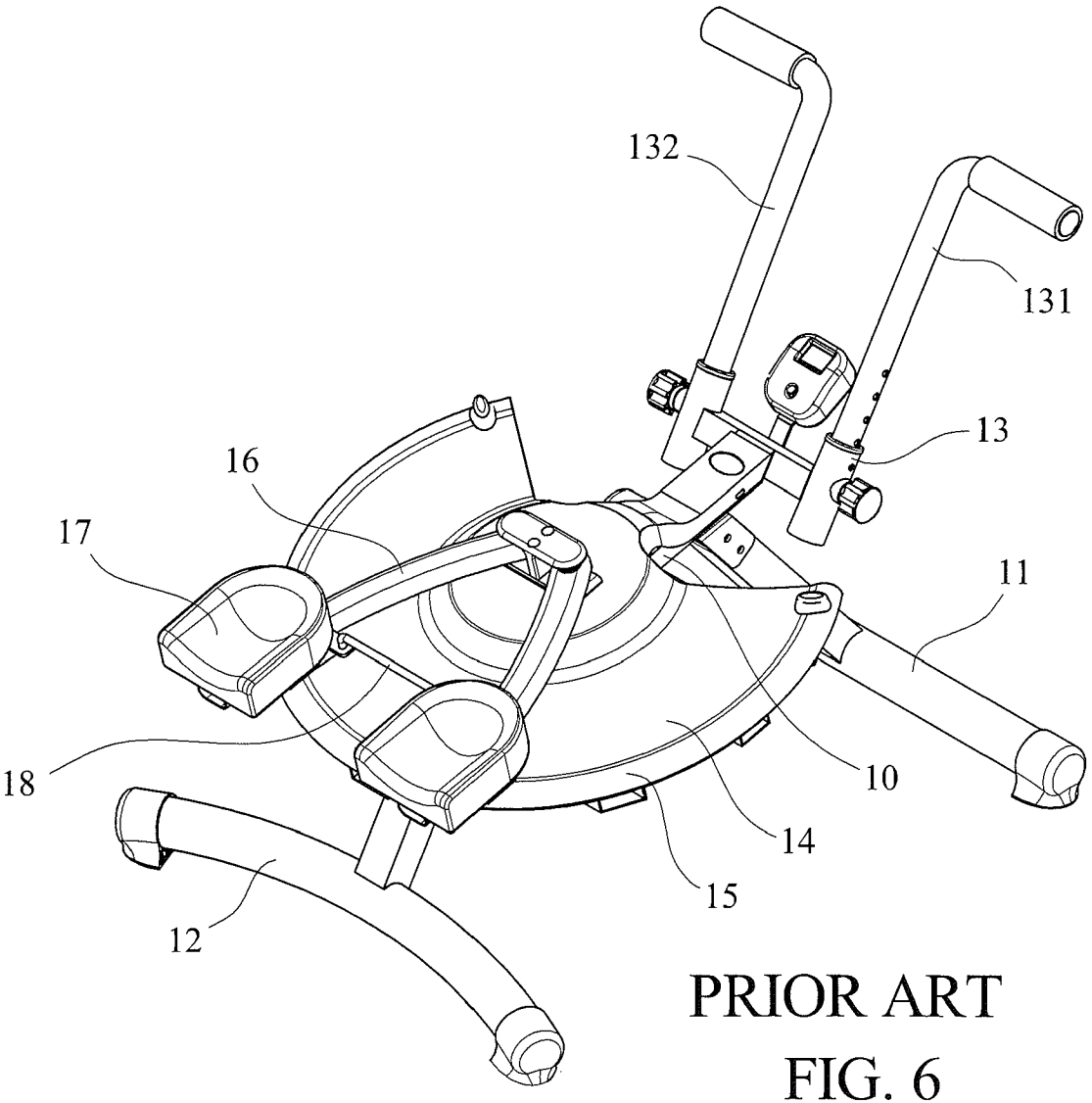
PRIOR ART FIG. 6
FIG. 6 is a perspective view of a typical swivel exerciser.

As shown in FIG. 4 specifically, in the other exercise mode, the inverted U-shaped bridge member 43 is detached so that one pair of the knee plate 41 and the pivotal arm 40 (i.e., the left ones) can rotate either clockwise or counter clockwise as indicated by one two-head arrow and the other pair of the knee plate 41 and the pivotal arm 40 (i.e., the right ones) can rotate either clockwise or counter clockwise as indicated by the other two-head arrow.

Advantages and characteristics of the invention are described below. Both knees can be effectively exercised by using the swivel exerciser. Moreover, two exercise modes are provided. Further, it is stable during exercise.

While the invention has been described in terms of preferred embodiments, those skilled in the art will recognize that the invention can be practiced with modifications within the spirit and scope of the appended claims.

What is claimed is:

1. A swivel exerciser comprising:

a base comprising two spaced front legs, a rear leg, a head tube and a longitudinal member, with a foot disposed on a bottom end of the head tube and two spaced hand grips disposed on a top end of the head tub, wherein the base is elevated by each of the two spaced front legs, the rear leg and the foot;

a sector-shaped plate disposed on a top of the base and comprising two central pivot members, with the longitudinal member extending from a front portion of the sector-shaped plate, with the head tube secured to the longitudinal member, with the two spaced front legs extending below the sector-shaped plate and located on opposite sides of the longitudinal member, with the two spaced front legs spaced from the longitudinal member and spaced from the head tube;

a curved rail disposed around a curved edge of the sector-shaped plate, with the curved rail being fixedly secured to the top of the base;

two pivotal arms rearward splayed out of the two central pivot members respectively;

a knee plate disposed on an end of each pivotal arm distal the pivot member and comprising a wheel disposed on the curved rail and adapted to move therealong;

a projection disposed at a joining portion of each pivotal arm and each knee plate and comprising a through hole; and an inverted U-shaped bridge member, wherein in a first operation mode, both ends of the inverted U-shaped bridge member are inserted into the through holes to interconnect the projections so that the knee plates can rotate as a whole; and wherein in a second operation mode, the projections are not connected by the inverted U-shaped bridge member so that one knee plate can rotate independently of the other knee plate.

2. The swivel exerciser of claim 1, further comprising a projecting stop member on a top of each end of the curved rail for preventing the wheels from moving out of the curved rail, with the two spaced front legs located intermediate the projecting stop members on the curved rail and the rear leg.

3. The swivel exerciser of claim 2, wherein the longitudinal member has C-shaped cross sections, with the longitudinal member comprising a threaded hole, and wherein the head tube comprises a through hole and a locating screw driven through the through hole into the threaded hole to secure the head tube to the base, with the locating screw being driven in a direction intermediate the two central pivot members.

4. The swivel exerciser of claim 1, further comprising a through hole on one end of either pivotal arm, with the through holes being pivotably put on the pivot members respectively, and two fasteners each driven through the through hole into the pivot member so that the pivotal arms and the sector-shaped plate can be pivotably fastened together.

5. The swivel exerciser of claim 4, further comprising a protective cap disposed on each of the pivot members.

* * * * *

(12) INTER PARTES REVIEW CERTIFICATE (3rd)
United States Patent
Tsai

(10) Number: US 8,052,583 K1
(45) Certificate Issued: Jan. 14, 2014

(54) SWIVEL EXERCISER

(75) Inventor: Jao-Hsing Tsai

(73) Assignee: Cheng-Kang Chu

Trial Number:

IPR2013-00212 filed Mar. 27, 2013

Petitioner: UKing Universe, Inc.

Patent Owner: Cheng-Kang Chu

Inter Partes Review Certificate for:

Patent No.: 8,052,583
Issued: Nov. 8, 2011
Appl. No.: 12/944,861
Filed: Nov. 12, 2010

The results of IPR2013-00212 are reflected in this inter partes review certificate under 35 U.S.C. 318(b).

INTER PARTES REVIEW CERTIFICATE
U.S. Patent 8,052,583 K1
Trial No. IPR2013-00212
Certificate Issued Jan. 14, 2014

AS A RESULT OF THE INTER PARTES REVIEW PROCEEDING, IT HAS BEEN DETERMINED THAT:

Claims 1-5 are canceled.

* * * * *